US008511340B2

(12) United States Patent
Smid et al.

(10) Patent No.: US 8,511,340 B2
(45) Date of Patent: Aug. 20, 2013

(54) SUCTION JET PUMP

(75) Inventors: Pavel Smid, Pribyslav (CZ); Radek Malec, Ceske Budejovice (CZ); Karsten Scholz, Schwieberdingen (DE); Jiri Kadlec, Ceske Budejovice (CZ)

(73) Assignee: Robert Bosch GmbH, Stuttgart (DE)

( * ) Notice: Subject to any disclaimer, the term of this patent is extended or adjusted under 35 U.S.C. 154(b) by 483 days.

(21) Appl. No.: 12/865,805

(22) PCT Filed: Dec. 9, 2008

(86) PCT No.: PCT/EP2008/067068

§ 371 (c)(1),
(2), (4) Date: Aug. 2, 2010

(87) PCT Pub. No.: WO2009/095132

PCT Pub. Date: Aug. 6, 2009

(65) Prior Publication Data

US 2010/0319793 A1 Dec. 23, 2010

(30) Foreign Application Priority Data

Feb. 1, 2008 (DE) ..... 10 2008 007 204

(51) Int. Cl.

| | |
|---|---|
| ***F04F 5/10*** | (2006.01) |
| ***F04F 5/44*** | (2006.01) |
| ***B01F 5/02*** | (2006.01) |
| ***F02M 37/10*** | (2006.01) |

(52) U.S. Cl.
USPC ..... 137/565.22; 137/565.34; 137/565.35; 137/895; 417/186

(58) Field of Classification Search
USPC ..... 137/565.22, 565.34, 565.35, 888, 137/895; 123/506; 417/169, 76, 186
See application file for complete search history.

(56) References Cited

U.S. PATENT DOCUMENTS

| | | | | |
|---|---|---|---|---|
| 5,070,849 | A * | 12/1991 | Rich et al. | 123/509 |
| 5,797,373 | A | 8/1998 | Kleppner et al. | |
| 6,364,625 | B1 * | 4/2002 | Sertier | 417/182 |
| 6,488,476 | B2 * | 12/2002 | Eck | 417/76 |
| 6,951,208 | B2 * | 10/2005 | Milton | 123/509 |
| 2004/0011337 | A1 | 1/2004 | Buehler | |
| 2007/0251508 | A1 | 11/2007 | Wattai et al. | |

FOREIGN PATENT DOCUMENTS

| | | | |
|---|---|---|---|
| DE | 10129437 | A1 | 1/2003 |
| DE | 10303390 | A1 | 8/2004 |
| EP | 0806318 | A2 | 11/1997 |
| GB | 2307948 | A | 6/1997 |
| WO | 2007133412 | A1 | 11/2007 |

* cited by examiner

*Primary Examiner* — Stephen M Hepperle
*Assistant Examiner* — Atif Chaudry
(74) *Attorney, Agent, or Firm* — Michael Best & Friedrich LLP

(57) ABSTRACT

Suction jet pumps include a driving line which leads via a jet outlet into a suction chamber, where the suction chamber has a suction opening which interacts with a valve element and through which fluid is sucked into the suction chamber. The valve element together with the suction opening forms a suction valve. The suction jet pump is driven by a driving stream flowing via the driving line. The suction jet pump is arranged in a storage tank and sucks fuel out of a fuel tank into the storage tank. The driving line has a bypass opening which leads into the suction chamber and is arranged in such a manner that the bypass stream thereof acts on the valve element.

12 Claims, 1 Drawing Sheet

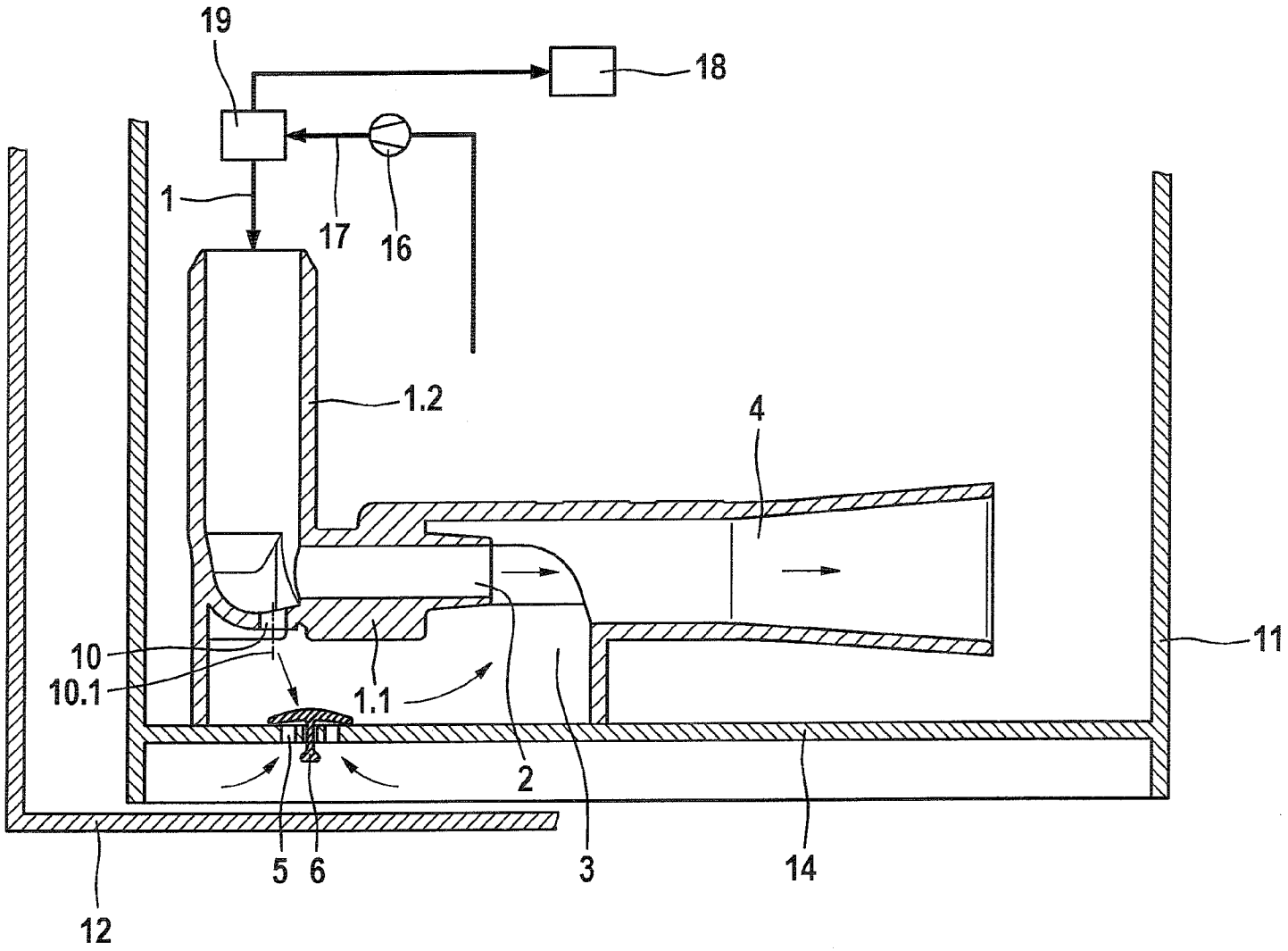
11
14
4
3
2
1.1
6
5
12
18
16
17
19
1
1.2
10
10.1

SUCTION JET PUMP

CROSS-REFERENCE TO RELATED APPLICATION

This application is a 35 USC 371 application of PCTIEP2008/067068 filed on Dec. 9, 2008.

BACKGROUND OF THE INVENTION

1. Field of the Invention

The invention is based on a suction jet pump.

2. Description of the Prior Art

A suction jet pump is already known from German Patent Disclosure DE 103 03 390 A1, having a drive line that discharges via a jet outlet into an intake chamber; the intake chamber has an intake opening, cooperating with a valve member, through which opening the fluid can be aspirated into the intake chamber. The valve member, together with the intake opening, forms an intake valve. The suction jet pump is driven by a driving flow that flows via the drive line. The suction jet pump is disposed in a storage tank and aspirates fuel from a fuel tank into the storage tank. At low levels in the fuel tank, it can happen that air is sometimes aspirated and conducted into the storage tank, as a result of which foaming occurs in the storage tank. However, with its large volume, the foam displaces fuel, and that can lead to a partial evacuation of the storage tank. This effect is also called dynamic leakage. A characteristic curve of the suction jet pump, representing the aspirated volumetric flow as a function of the driving flow, has a comparatively steep course. Pronounced foaming does not occur until past a critical underpressure area in the intake region of the suction jet pump, which will hereinafter be called the foam limit.

From German Patent Disclosure DE 198 28 934 A1, a suction jet pump is known, having a drive line that upstream of the jet outlet has an overpressure valve, which causes fuel, beyond a predetermined pressure, in the drive line to flow away via a valve outlet directly into the storage tank.

ADVANTAGES AND SUMMARY OF THE INVENTION

The suction jet pump of the invention has the advantage over the prior art that the foaming is avoided or at least reduced because the drive line has a bypass opening which discharges into the intake chamber and disposed such that its bypass flow acts on the valve member. In this way, an additional flow resistance, directly dependent on the driving flow, is generated at the intake opening, so that the characteristic curve of the suction jet pump has a shallower course than in the prior art. Thus the suction jet pump can be designed such that its suction power, or its intake flow, is above the minimum power and below the foam limit in the desired driving flow region.

In an advantageous feature, the bypass opening is disposed in the region above the valve member.

It is especially advantageous if the drive line extends with an end portion into the intake chamber, and the bypass opening is provided in the end portion.

It is also advantageous if the valve member is provided in some portions in the intake chamber, since in this way, the fluid flowing through the bypass opening can best act on the valve member.

In an advantageous feature, it is provided that the valve member be embodied in umbrella-like form, since such a valve can be produced especially economically, provides reliable sealing, and has a large effective area for the flow through the bypass opening.

BRIEF DESCRIPTION OF THE DRAWINGS

One exemplary embodiment of the invention is explained in further detail in the ensuing description in conjuction with the drawing, in which:

FIG. 1 shows in section, a suction jet pump according to the invention.

DESCRIPTION OF THE PREFERRED EMBODIMENT

The drawing shows a suction jet pump of the invention in section.

The suction jet pump has a drive line 1, which discharges via a jet outlet 2 into an intake chamber 3. The jet outlet 2 is for instance embodied as narrowed in nozzlelike form. A mixing conduit 4 is disposed on the intake chamber 3, in an imaginary extension of the jet outlet 2, in such a way that a fluid stream emerging from the jet outlet 2 of the drive line 1 reaches the inside of the mixing conduit 4 in a straight line via the intake chamber 3. The cross sections of the jet outlet 2 and mixing conduit 4 therefore overlap in projection.

The mode of operation of a suction jet pump is well known, so that it will be described only briefly here: Via the drive line 1 and its jet outlet 2, a driving flow is introduced in streamlike form into the intake chamber 3. The driving flow is an arbitrary liquid, but in principle it could also be a gas. The driving stream of the drive line 1 carries surrounding fluid from the intake chamber 3 along with it into the mixing conduit 4. As a result, an underpressure is created in the intake chamber 3, which causes replenishing fluid to flow out of the surroundings of the suction jet pump into the intake chamber 3, via an intake opening 5 of the intake chamber 3. A valve member 6 is provided at the intake opening 5 and cooperates with the intake opening 5 and with it forms a check valve. The valve member 6 in this embodiment is embodied in umbrella-like form but may also be embodied in arbitrary other ways, such as T-shaped, double-T-shaped, conical, spherical, disklike, or cylindrical. The valve member 6 may be embodied as elastic or rigid.

According to the invention, it is provided that the drive line 1 has a bypass opening 10, which discharges into the intake chamber 3 and is disposed such that its bypass flow acts indirectly or directly on the valve member 6. The bypass flow acts on the valve member 6 in a closing manner, that is, counter to the opening direction of the check valve. For instance, the bypass opening 10 is aimed at the valve member 6 in such a way that the stream or flow of the bypass opening 10 strikes the valve member 6. It is at least provided that the volumetric flow of the bypass opening 10 spills over the valve member 6 and in the process exerts flow forces thereon.

The bypass opening 10 is designed and disposed such that its bypass flow exerts such a strong force on the valve member 6 that the valve member 6 is movable in the direction of its valve seat. The bypass opening 10 may be embodied such that the valve member 6 can be closed completely by means of the bypass flow of the bypass opening 10. The diameter of the bypass opening 10 must be smaller than that of the jet outlet 2 of the drive line 1.

In this way, an additional flow resistance, directly dependent on the driving flow, is generated at the intake opening 5 and increasingly lessens the increase in suction power as the driving flow increases. As a result, the characteristic curve of the suction jet pump, representing the volumetric flow aspirated via the intake opening 5 as a function of the driving flow, has a shallower course than in the prior art. Hence the suction jet pump can be designed such that its suction power in the desired driving flow region is above the minimum power and below the critical foam limit. As a result of the embodiment according to the invention, foaming downstream of the mixing conduit 4 from aspiration of air is avoided or at least reduced. A self-regulating suction jet pump is achieved.

With a portion 1.1, the drive line 1 extends into the intake chamber 3, and the bypass opening 10 is located in the portion 1.1. A portion 1.2, angled relative to the portion 1.1, is for instance embodied upstream of the portion 1.1, and the bypass opening 10 is disposed for instance in the vicinity of the angle between the two portions. The bypass opening 10 is embodied for instance on the underside of the portion 1.1, oriented toward the bottom 14. The intake opening 5 is provided on the bottom 14, in the region below the bypass opening 10.

The bypass opening 10 has an axis 10.1, which is aligned parallel with the intake opening 5 and the valve member 6 and can extend either perpendicular or obliquely relative to the bottom 14 of the storage tank. The axis 10.1 may be aligned with the axis of the intake opening 5. However, the intake opening 5 may also be offset from the bypass opening 10, as depicted in FIG. 1.

In the embodiment in FIG. 1, the suction jet pump is provided in a cup-shaped storage tank 11, which is disposed in a fuel supply tank 12. The intake chamber 3 of the suction jet pump is embodied as open on one end, for instance, and rests with the open end on a bottom 14 of the storage tank 11, as a result of which the open end of the intake chamber 3 is closed. The intake opening 5 of the intake chamber 3, in the exemplary embodiment, is provided on the bottom 14 of the storage tank 11 but could also be embodied on the housing of the suction jet pump. The check valve formed by the intake opening 5 and the valve member 6 prevents a return flow of liquid from the storage tank 11 back into the fuel supply tank 12 via the mixing conduit 4 and the intake chamber 3.

The mixing conduit 4 extends for instance horizontally in the direction of the bottom 14 of the storage tank 11.

In the suction jet pump of the invention, some of the driving flow flows via the jet outlet 2, and a remaining portion of the driving flow via the bypass opening 10 into the intake chamber 3. The portion flowing via the bypass opening 10 generates an additional flow resistance or pressure loss at the check valve, the value of which is dependent on the driving quantity. The greater the driving flow, the greater the pressure loss that is generated. In the intake chamber 3, the bypass flow of the bypass opening 10 is aspirated and flows, like the aspirated flow that is aspirated via the intake opening 5, along with the flow of the driving stream into the storage tank 11 via the mixing conduit 4.

The suction jet pump according to the invention shown in FIG. 1 may be employed for instance in an apparatus for delivering fuel. This apparatus has for instance a delivery unit 16, which aspirates fuel from the storage tank 11 and delivers it, at increased pressure, via a pressure line 17 to an internal combustion engine 18. The drive line 1 branches off from the pressure line 17, and a pressure-regulating valve 19 may be provided, which only beyond a predetermined pressure allows fuel to flow out of the pressure line 17 into the drive line 1. The storage tank 11 keeps enough fuel in reserve for the delivery unit 16 that the delivery unit can aspirate fuel even at low levels in the fuel supply tank 12 and upon acceleration, braking, cornering, and/or climbing hills. By means of the suction jet pump of the invention, a partial evacuation of the storage tank 11 from aspiration of air and attendant foaming is avoided.

The foregoing relates to the preferred exemplary embodiment of the invention, it being understood that other variants and embodiments thereof are possible within the spirit and scope of the invention, the latter being defined by the appended claims.

The invention claimed is:

1. A suction jet pump, having a drive line that discharges via a jet outlet into an intake chamber, the intake chamber having an intake opening cooperating with a valve member, through which intake opening the fluid can be aspirated into the intake chamber, wherein the drive line has a bypass opening which discharges into the intake chamber and is disposed such that its bypass flow acts on the valve member, and wherein the bypass flow strikes the valve member to exert a force that urges the valve member in a closing direction.

2. The suction jet pump as defined by claim 1, wherein the bypass opening is disposed in region disposed above the valve member.

3. An apparatus for delivering fuel, having a suction jet pump as defined by claim 2.

4. The suction jet pump as defined by claim 1, wherein the drive line extends with an end portion thereof into the intake chamber, and the bypass opening is provided in the end portion.

5. An apparatus for delivering fuel, having a suction jet pump as defined by claim 4.

6. The suction jet pump as defined by claim 1, wherein the valve member is provided in a portion of the intake chamber.

7. An apparatus for delivering fuel, having a suction jet pump as defined by claim 6.

8. The suction jet pump as defined by claim 1, wherein the valve member is embodied as umbrella-shaped, or disklike.

9. An apparatus for delivering fuel, having a suction jet pump as defined by claim 8.

10. An apparatus for delivering fuel, having a suction jet pump as defined by claim 1.

11. The suction jet pump as defined by claim 1, wherein the valve member is disposed directly beneath the bypass opening.

12. The suction jet pump as defined by claim 1, wherein the bypass opening is always open.

* * * * *